US005303434A

United States Patent [19]

Arnold

[11] Patent Number: 5,303,434

[45] Date of Patent: Apr. 19, 1994

[54] BED TENT

[76] Inventor: William T. Arnold, 400 Redrome Cir. East, Bridgeville, Pa. 15017

[21] Appl. No.: 964,764

[22] Filed: Oct. 22, 1992

[51] Int. Cl.[5] ..... A47C 29/00

[52] U.S. Cl. ..... 5/414; 5/505.1; 135/102

[58] Field of Search ..... 5/414, 505.1, 512, 416, 5/413, 658; 135/90, 102

[56] References Cited

U.S. PATENT DOCUMENTS

| | | | |
|---|---|---|---|
| 193,745 | 7/1877 | Young | 135/90 |
| 492,298 | 2/1893 | Johnson | 5/414 |
| 655,875 | 8/1900 | Johnson | 5/414 |
| 668,543 | 2/1901 | Rowlings | 5/414 |
| 4,427,021 | 1/1984 | Cater | 5/414 |
| 4,489,451 | 12/1984 | Neely | 5/414 |
| 4,852,598 | 8/1989 | Griesenbeck | 5/414 |
| 4,914,768 | 4/1990 | Howard | 5/414 |

FOREIGN PATENT DOCUMENTS

| | | | |
|---|---|---|---|
| 16768 | of 1915 | United Kingdom | 5/414 |
| 2163047 | 2/1986 | United Kingdom | 5/414 |

*Primary Examiner*—Peter M. Cuomo
*Assistant Examiner*—Flemming Saether

[57] ABSTRACT

A bed tent (10) with a support portion (16, 18, 30) is erected over a bed and a canopy portion (12) draped over the support portion (16, 18, 30). The canopy portion (12) may be connected to portion (12) provides an enclosure having an open bottom surface area and an opening (26) for entering and exiting the enclosure.

10 Claims, 3 Drawing Sheets

BED TENT

BACKGROUND OF THE INVENTION

The invention relates generally to accessories for use with beds and specifically relates to providing a fun atmosphere in children's beds.

Children enjoy the idea of camping, sleeping outside in a tent, roasting marshmallows over an open fire, and the excitement of a different sleeping arrangement. Unfortunately, when they are taken outside and sense how dark it is and fear that wild animals would be lurking around the tent, they often change their minds and sleep inside.

This can be very frustrating to the parents who have taken the time to set up the tent in the yard and bring out the sleeping bags, pillows, flashlights, security blankets, and snacks.

Previous attempts have been made to provide a tent-like cover over a conventional bed.

U.S. Pat. No. 4,489,451 to Neely provides for a sheet to extend over a support frame of welded angle iron that is connected to the bed frame. Four vertically orientated posts are welded to the support frame near each corner of the bed and are braced by a horizontal bar to form two U-shaped frames. The sheet is then tucked under the mattress at the foot of the bed, extended over the horizontal bars where four pre-formed holes in the sheet line up with the posts, and the other end of the sheet is draped over the headboard with a weight inserted to maintain tension in the sheet. The device of the Neely patent is not well suited for use for children. The bed tent design of the Neely patent is expensive and awkward. The bed tent disclosed in the Neely patent is cumbersome to assemble and only provides rigid fixed positions to place the posts and no allowance for varying the location or height of the horizontal bars.

The bed tent disclosed in U.S. Pat. No. 4,852,598 to Griesenbeck allows for a form-fitted special tent to be fitted onto an existing mattress with two supports that form a dome-like structure over the mattress and is geared for children. There are several drawbacks to this design. This system requires the removal of the existing bedding. Additionally, no variation exists to change the design from the dome-shaped form, and the assembly is time-consuming and tedious.

Therefore, it is the object of the present invention to overcome the drawbacks of the prior art. The present invention provides a bed tent which allows privacy to persons within the bed and which is light in weight, easy to assemble, adaptable to a variety of shapes, and requires no additional room space.

It is a further object of the present invention to provide a bed tent which may be used with a conventional bed sheet or a manufactured sheet.

It is yet another object of the present invention to provide a bed tent that requires no tools to assemble, can be erected and taken apart easily by one person, and can be stored and transported easily.

SUMMARY OF THE INVENTION

According to the present invention, a bed tent is provided which includes two adjustable U-shaped frames and two Velcro tension straps that will support a conventional sheet or a manufactured sheet. One end of the sheet is tucked between the mattress and the bed frame. The sheet is then connected to the U-shaped frames by use of pins or clamps for a conventional sheet, or material loops which are sewn to a manufactured sheet. The U-shaped frames are then pulled forward to the opposite end of the bed and positioned in the proper orientation. The Velcro tension straps are then fastened from the front most U-shaped frame to the headboard or mattress frame and pulled tight to provide tension in the sheet. The sheet will then be supported by the tension straps and the U-shaped frames. An opening may be provided in the sheet to provide for entering and exiting by the user.

The present invention further provides a pair of adjustable, generally U-shaped frame members, each said frame member including a horizontal plastic tube member which is supported by a plurality of interconnected plastic tube members in a position above the mattress of the bed. A canopy portion is attached to and supported by said frame members forming an enclosed area above the mattress. The height of at least one of the said frame members may be changed by adding or removing some of the said tubing members from the ends thereof thus allowing for adjustability in the said frame members.

The present invention even further provides a manufactured sheet that includes loops arranged and sewn symmetrically about a center line. The said loops are arranged in several rows. The adjustability of said frame members and the use of a combination of the said rows of loops of the sheet allows for varying the position and orientation of said canopy portion with respect to the bed and overall configuration of said canopy portion and said enclosed area. The said manufactured sheet also includes an entrance and fastening means for keeping the said entrance open. Where a conventional sheet is used as the canopy portion the attaching means to the said frame members may include spring-biased clamps.

The invention may, obviously, be in the form of a child's toy comprising a tent with a support portion adapted to be quickly and easily erected over the existing bed and bedding with the sheet forming a canopy portion disposed over and connected to the support portion so as to form an enclosure over the child's bed with means for entering and exiting.

The bed tents disclosed herein are unique means for providing privacy and protection over the bed of the user. The bed tents of the invention offer an inexpensive and portable method for creating an enclosure over the bed of an individual, but which occupies no additional space, requires no special anchoring, does not interfere with the existing bedding, and can easily be adjusted into various shapes to accommodate different preferences of the user.

BRIEF DESCRIPTION OF THE DRAWINGS

The apparatus of the invention is further described and explained in relation to the drawings and the detailed description set forth below. The description of the invention will be better understood by reference to the following drawings wherein.

DESCRIPTION OF THE PREFERRED EMBODIMENT

Figure 1:
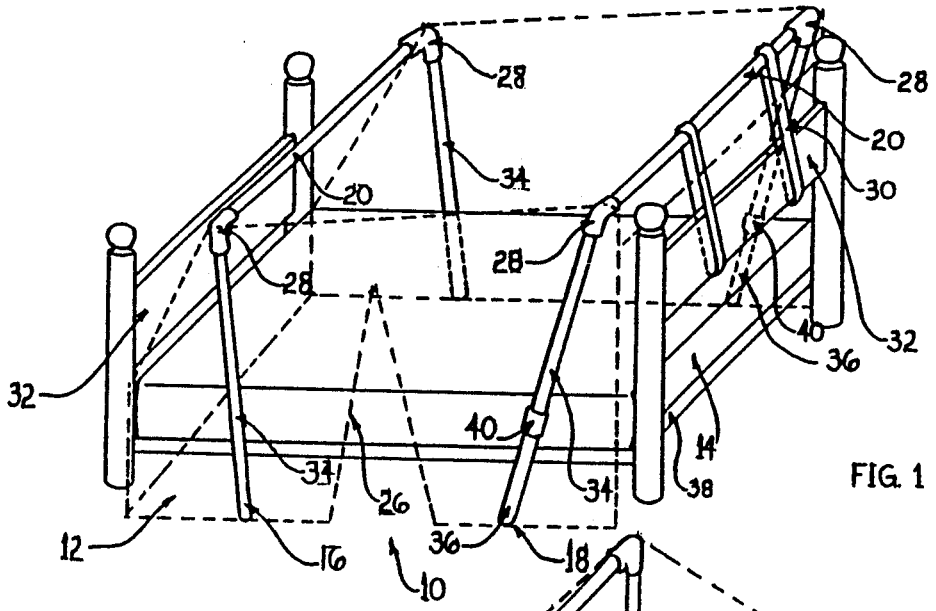
FIG. 1 depicts a perspective view of a preferred embodiment of the bed tent of the present invention wherein the U-shaped frames are positioned at opposite ends of the bed with the open end of the tent having the extensions to create a higher inside ceiling at the open end of the bed.
Figure 2:
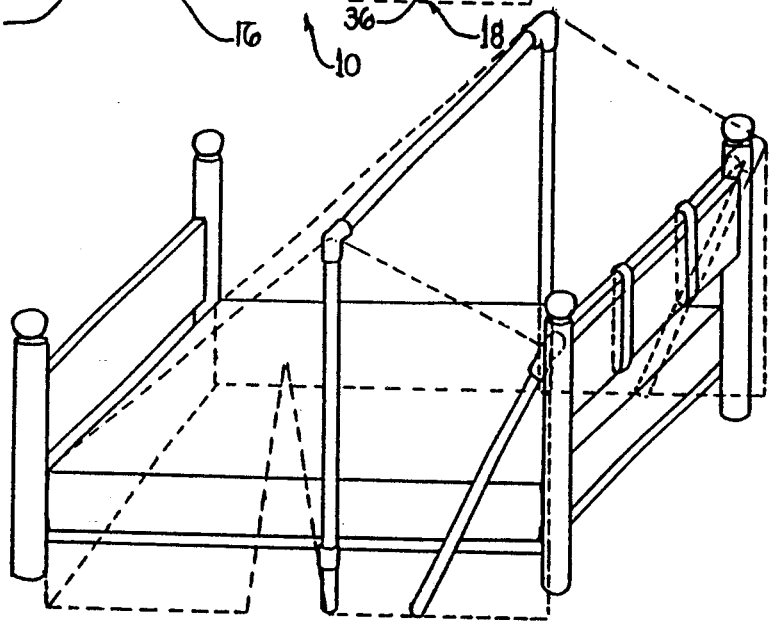
FIG. 2 depicts a perspective view of the bed tent of the present invention wherein the U-shaped frames are positioned on the same half of the bed with the open end of the tent having the shorter U-shaped frame and the middle having the U-shaped frame with extensions to create a higher ceiling at the center of the bed.
Figure 3:
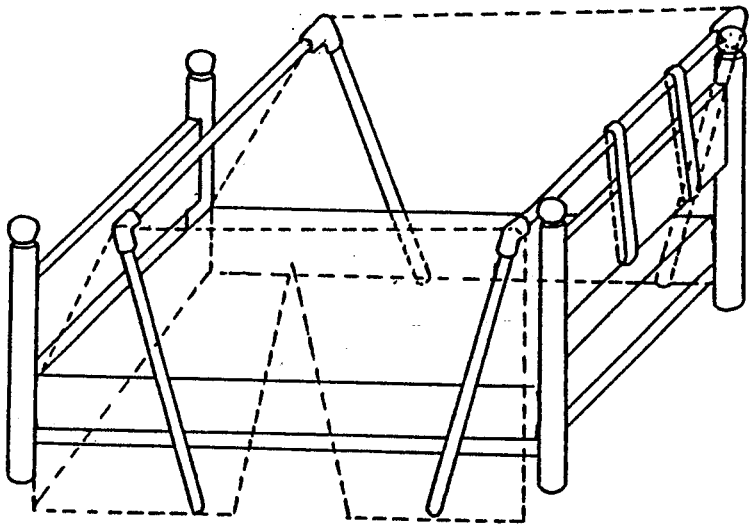
FIG. 3 depicts a perspective view of the bed tent of the present invention wherein the U-shaped frames are positioned at opposite ends of the bed with the extensions not used to create a lower ceiling throughout the tent.

Referring to FIGS. 1, 2, and 3, a bed tent 10 preferably comprises a canopy portion 12 adapted to provide a substantially upright enclosure over the mattress 14 and a support portion to provide support for the canopy portion 12. The support portion includes two U-shaped frame members 16 and 18. Canopy portion 12 may be constructed of several different material types depending upon intended use. When the bed tent 10 is intended for interior use as a child's toy, for example, the canopy portion 12 may be constructed of conventional cotton sheeting material and may be formed from a conventional bed sheet. Where the bed tent 10 is intended for outdoor use, the canopy portion 12 may be constructed of water-repellent materials such as plastic, canvas, impregnated nylon and the like. Where bed tent 10 is intended as an insect barrier, the canopy portion 12 may be constructed from more loosely woven material which permits the passage of light and/or air but impedes the passage of insects therethrough. If the bed tent 10 is intended for use as an oxygen tent in a medical application, the canopy portion 12 can comprise a polymeric material which is more impervious to the passage of an oxygen-containing gas therethrough.

In one preferred embodiment of the invention, the canopy portion 12 can be connected to the horizontal bar 20 of at least one of the support frame members 16 and 18. Canopy portion 12 may be connected to the frame members 16 and 18 by loops 24 which are sewn at several locations within the canopy portion 12 to allow for varying bed tent 10 shapes (see FIG. 4). The manner in which the loops 24 are connected to the canopy portion 12 can vary according to the material utilized for the canopy portion 12 and further depending on the intended use. Thus, for example, where canopy portion 12 is constructed of conventional sheeting material, the attachment of loops 24 may comprise conventional stitching done by hand, a sewing machine, or the like. In this instance, multiple rows of stitching along the loops 24 can assist in making the bed tent 10 more durable and serviceable over a prolonged period.

In addition to the horizontal canopy surface, the canopy portion also comprises sides and ends. The ends may be adapted with loops 24 to allow for either end of the canopy to be used as the open end 22. The end opposite the open end 22 will be tucked in between the mattress 14 and the mattress frame 38. The sides of the canopy portion 12 will hang free to allow for proper air ventilation throughout the inside of the bed tent 10. Although the means shown in FIG. 1 for fastening the canopy 12 to the support portion and letting the sides hang loose is a preferred means for use in the apparatus of the invention, other similarly effective arrangements can also be employed within a scope of the present invention. For example, if the bed tent 10 is to function as an oxygen tent, the sides may be tucked in all around the edge of the mattress 14 and a zipper closing employed to assure a sealed tent environment.

With the preferred embodiment shown in FIG. 1 however, bed tent 10 is preferably spread out over mattress 14 and folded back with underlying loops 24 exposed so the support portion may be connected to the chosen loops 24 and drawn forward to the end of the bed to attach the tension straps 30 to form a tent for as long as may be desired.

As stated above, canopy portion 12 is preferably constructed of a material having characteristics consistent with the intended use. Thus, where the passage of light and air through canopy portion 12 is desired, a more loosely woven fabric is desirably employed than if the intended function of canopy portion 12 is to repel water or provide more complete privacy for the user.

Canopy portion 12 may be reinforced at the loops 24 to resist tearing of the seam at those locations and to provide increased support for the U-shaped support frames 16 and 18 of the support portion. The support portion may be glued at the elbows 28 which are joined to the horizontal bar 20 of each U-shaped support frame 16 and 18 and to add rigidity to the structure. Other intersections of the support frames should have no glue to enable easy assembly and disassembly and complete versatility in the preferred tent shape. The ends of the U-shaped supports 16 and 18 that rest on the floor may simply be the open ends of the tubular plastic if erected on carpet or capped with rubber tips if erected on a smooth floor to reduce slippage of the support frames. Tension straps 30 extend between from the horizontal bar 20 of one of the support frames and a position of the bed frame, such as a headboard 32. Although the tension straps 30 shown in FIG. 1 are made of Velcro material and is the preferred tension means of use with the canopy portion 12, it will be apparent that other similarly effective tension devices including, for example, ties, elastic strips, and the like can similarly be employed within the scope of the invention. Material strips may be sewn inside the canopy to provide for maintaining door flaps in the open position. However, other similarly effective means including ties, buttons, Velcro strips, and the like can also be employed for this purpose.

Figure 5:
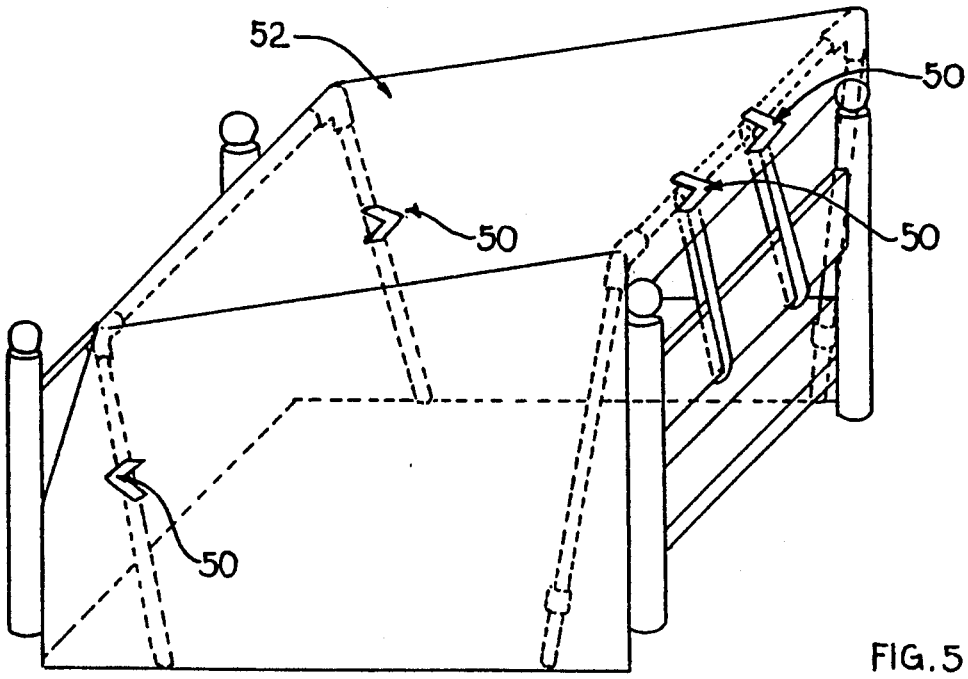
FIG. 5 depicts a perspective view of a bed tent of the present invention which utilizes a conventional bed sheet and spring-biased clamps.

The canopy portion 12 is provided with attaching means to attach the canopy portion 12 to the frame members 16 and 18. As discussed above, these attaching means may be formed by loops 24 sewn to various positions on the underside of the canopy portion 12. The attaching means may also include snaps or the like. If the canopy portion 12 is formed of a conventional bed sheet 52 , then the attaching means may be formed of pins or clamps 50, as shown in FIG. 5, which secure the canopy portion 12 to the support portion.

Referring to FIG. 1, each of support portion frame members 16 and 18 is rigid enough to maintain canopy portion 12 in its desired upright position with the aid of the tensioning straps 30. According to the embodiment of the invention shown in FIG. 1, each frame member 16 and 18 comprises a plurality of tubular plastic members 34 interconnected by a plurality of plastic junction elbows 28 and sleeves 40. The tubular plastic members 34 may be joined with the elbows 28 and sleeves 40 in a variety of designs, and attached to the canopy portion 12 to provide a substantially rigid support structure. Frame members 16 and 18, as shown in FIG. 1–3, are preferred for use in the bed tent 10 because they are easily disassembled to a length which can be more conveniently packed or carried. Nevertheless, it will be understood and appreciated that rigid dowels, fiberglass rods, graphite rods, metal rods, and the like may also be used within the scope of the present invention. The tubular members 20, 28, 34, and 40 are connected to form the two primary support structures or U-shaped frames 16 and 18 which are to form a framework defining the interior dimensions of the tent 10. With the framework erected through the canopy loops 24 and stood upward from the floor, the one end of the canopy portion 12 tucked between the mattress 14 and the mattress frame, and one of the canopy's support U-shaped frames 16 and 18 snugly secured with the tension straps 30 to the bed headboard 32 or mattress frame 38, the framework is secured in position and the entire assembly held in fixed position. The framework 16 and 18 thus supports the canopy portion 12 and is itself held in position by the canopy portion 12, the tension straps 30, and the mattress 14.

FIGS. 2 and 3 illustrate two alternative tent shape configurations which may be obtained utilizing the versatile frame members 16 and 18 of the present invention. FIG. 2 relocates the frame members 16 and 18 from the positions shown in FIG. 1 to provide a tent shape with a higher central portion. FIG. 3 represents yet another configuration wherein tubular members 36 and connecting sleeves 40 have been removed from frame member 16 or 18. These figures obviously do not illustrate all the possible arrangements of the present invention, but these figures demonstrate the inherent flexibility of the bed tent 10 design with the frame structure of the present invention.

Figure 4:
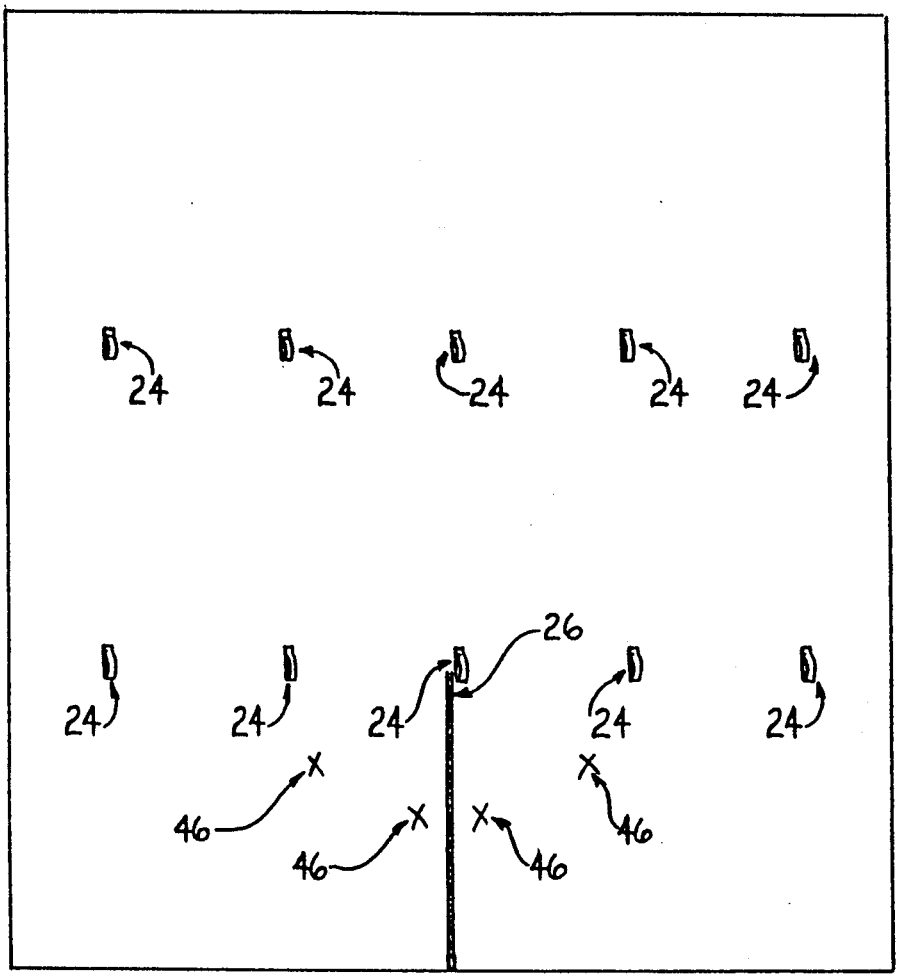
FIG. 4 depicts a perspective view of the manufactured sheet of the present invention wherein the material loops, ties, and entrance are positioned in a mirror-image pattern to allow for the open end of the tent to be at either end of the bed.

FIG. 4 illustrates the manufactured sheet 12 and shows the required positions for each of the loops 24 and entrance closures 46 as well as the entrance 26 itself. The dimensions show the loops 24 are placed in a series of rows symmetrical to a center line. A row is comprised of a pair of loops 24 and the rows align parallel to the entrance 26 line. There are five rows of loops 24, one entrance 26, and four closures 46 for maintaining the entrance 26 in the open position. If an imaginary line is drawn connecting the loops 24 in the center row, a mirror image is created showing similar positions on both sides of the line. This is to allow for the open end 22 of the canopy portion 12 to be at either end.

FIG. 5 illustrates the bed tent 10 of the present invention which utilizes a conventional bed sheet 52 for the canopy portion 12. The frame members 16 and 18 are in the configuration shown in FIG. 1 and is attached to the canopy portion 12 by spring-biased clamps 50. This allows the bed tent 10 of the present invention to utilize the bed sheet presently on the bed without destroying the bed sheet or requiring the manufacture of a second specialized sheet which can only be used for the canopy portion 12.

Figure 6:
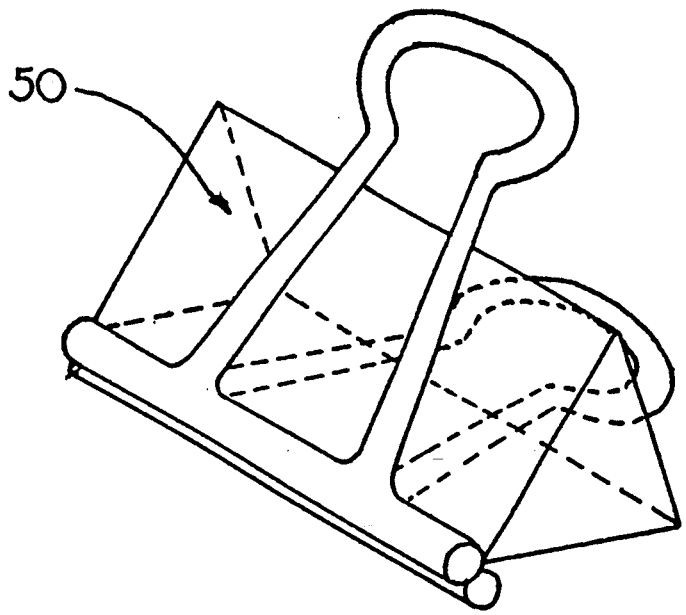
FIG. 6 depicts a perspective view of a spring-biased clamp used to fasten a conventional bed sheet to the U-shaped frame members.

FIG. 6 illustrates the spring-biased clamp 50 to be used to hold the conventional sheet 52 to the frame members 16 and 18. Two clamps 50 may be used on each of the frame members 16 and 18, as shown in FIG. 5, to help maintain tension in the canopy portion 12 without disturbing the conventional sheet 52.

What is claimed:

1. A tent forming assembly for use with a conventional bed having a bed-frame supporting mattress, said tent forming assembly comprising:

(a) a pair of generally U-shaped frame members adjustably positioned beside the bed, each said frame member including a pair of leg members supported on a floor and a horizontal bar which is supported by said leg members in a position above the mattress of the bed;

(b) a canopy portion attached to and supported by said frame members forming an enclosed area above the mattress;

(c) attaching means for attaching said canopy portion to said frame members; and (d) tensioning means attached to one of said frame members and attached to the bed-frame for maintaining tension within at least a portion of said canopy portion;

wherein said adjustability of said frame members allows for varying the position of said frame members longitudinally beside the bed and orientation of said frame members with respect to the bed to alter the height and overall configuration of said canopy portion and said enclosed area.

2. The tent forming assembly of claim 1 wherein said canopy portion is formed of a conventional bed sheet.

3. The tent forming assembly of claim 1 wherein said attaching means include spring-biased clamps.

4. The tent forming assembly of claim 1 wherein each said frame member is formed of a plurality of interconnected plastic tubing members.

5. The tent forming assembly of claim 4 wherein the height of at least one of said frame members may be changed by adding or removing some of said tubing members from the ends thereof.

6. The tent forming assembly of claim 1 wherein said tensioning means include Velcro straps attached to one said horizontal bar.

7. The tent forming assembly of claim 1 wherein said tensioning means include Velcro straps which are attached to the bed frame frame itself.

8. The tent forming assembly of claim 1 wherein said attachment means are loops sewn to the underside of said canopy portion.

9. The tent forming assembly of claim 8 wherein said loops are sewn in rows which are arranged symmetrically about a center line of said canopy portion.

10. The tent forming assembly of claim 1 wherein said canopy portion includes an entrance and fastening means for maintaining said entrance open.

* * * * *